US006810665B2

(12) United States Patent
Chien et al.

(10) Patent No.: US 6,810,665 B2
(45) Date of Patent: Nov. 2, 2004

(54) STIRLING ENGINE WITH VARIABLE STROKE

(75) Inventors: Kuo-Hsiang Chien, Hsinchu (TW); Li-Ming Liou, Taoyuan (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 10/357,446

(22) Filed: Feb. 4, 2003

(65) Prior Publication Data

US 2004/0112048 A1 Jun. 17, 2004

(30) Foreign Application Priority Data

Dec. 13, 2002 (TW) ..... 91136191 A

(51) Int. Cl.[7] ..... F01B 29/10
(52) U.S. Cl. ..... 60/517; 91/504
(58) Field of Search ..... 60/517; 91/504, 91/505, 506

(56) References Cited

U.S. PATENT DOCUMENTS

| | | | | | |
|---|---|---|---|---|---|
| 3,633,464 | A | * | 1/1972 | Aoyama et al. | 91/505 |
| 3,733,963 | A | * | 5/1973 | Kubilos | 91/3 |
| 3,736,073 | A | * | 5/1973 | Walmsley | 417/222.1 |
| 4,372,116 | A | * | 2/1983 | Dineen | 60/525 |
| 4,381,702 | A | * | 5/1983 | Myers | 91/506 |
| 4,896,585 | A | * | 1/1990 | Forster | 92/12.2 |
| 4,898,077 | A | * | 2/1990 | McBeth | 91/505 |
| 4,934,253 | A | * | 6/1990 | Berthold et al. | 91/506 |
| 2002/0141880 | A1 | | 10/2002 | Ahn et al. | |

* cited by examiner

*Primary Examiner*—Hoang Nguyen
(74) *Attorney, Agent, or Firm*—Birch, Stewart, Kolasch & Birch, LLP

(57) ABSTRACT

A stirling engine with variable stroke can change output power in the same rotating speed. By an adjuster, it changes the contact position of the piston connecting rods and the swash plate to cause the connecting rods have different track on the swash plate. Then there will produce different distance to change the stroke of the piston of the engine. It changes the torque to control the output power.

8 Claims, 4 Drawing Sheets

STIRLING ENGINE WITH VARIABLE STROKE

FIELD OF THE INVENTION

The invention relates to a stirling engine with a variable stroke adopted for use on carriers as a driving source, particularly to a stirling engine with a variable stroke controlling output power by altering the contact position between a piston connecting rod and a swash plate.

BACKGROUND OF THE INVENTION

In the four-cylinder double acting stirling engine the swash plate is a critical transmission component. It transforms the reciprocal motion of the connecting rods of four cylinders to rotation of the output shaft. The generator driven by the engine output shaft must maintain a steady rotation to avoid unstable power supply frequency or voltage and prevent a drop of power supply quality. Output power of the stirling engine is based on a full load condition. When the load changes, the rotation speed of the engine changes. As a result, the quality and stability of power generation are affected.

To employ the stirling engine directly as the driving source of a carrier, the main purpose is to minimize the use of special material and unconventional oil seals for the rotary shaft and expensive pressure control systems, and to avoid design of a heating pipe with a complex exterior profile (which is expensive in assembly and soldering). Further, to use low cost air preheating. The material problem has been solved because of a special alloy CRM 6D (developed by Chrysler in 1963). The oil seal and pressure control problems are still severe due to leakage of the oil seals during reciprocal sliding movement. Much high pressure gas tends to leak into the crank shaft box. The gas must be collected and compressed to be channeled back to the work area of the engine. The leaking of high pressure gas through the oil seals of the rotary shaft to the crank shaft box is the most difficult problem. In order to control the engine power by altering the gas pressure, pressure boosting in the crank shaft box also has to be made swiftly. However, such a practice causes leaking of lube oil from the crank shaft box under high gas pressure. This is still a problem without effective solutions. Moreover, a duplex pressure control system is very expensive. This counts especially for a double-acting circulatory engine. Therefore, adopting the design of a constant engine operating pressure and variable piston stroke to control engine output power not only can alleviate the air pressure problem of the oil seals, the leakage problem of lube oil due to rapid change of operating pressure can also be avoided.

To maintain the stability of engine operation, engine output power must be changed according to load-variations. To change the engine output power under constant rotation speed, the main approach is to alter the moving stroke of the engine piston. By doing so, the torque is changed to control the output power. Hence, by adopting a mechanism of variable piston strokes on the swash plate (to alter the output torque of the engine) output power is also controlled according to load- variations.

SUMMARY OF THE INVENTION

The primary object of the invention is to provide variable strokes for engine operations. In view of the difficulty involved in direct altering of engine operating pressure, the design of the invention aims at altering of the engine torque. As the swash plate is the main transmission mechanism of the stirling engine, the variable engine stroke may be altered by directly controlling the angle of the swash plate. While such a design can harness the motion displacement of the piston connecting rod, it is more complicated in fabrication and assembly. Therefore this invention provides a new control method that effectively controls the piston motion stroke during the transmission process (between the piston and the swash plate, while the engine is operating without changing the moving angle of the swash plate).

The invention adopts an approach that directly changes the contact position of the piston connecting rod and the swash plate without altering the angle and position of the swash plate. Thereby, the invention enables the connecting rod to form different perimeter tracks of movement on the swash plate and generate different height variations.

The stirling engine of the variable stroke of the invention has a rotary shaft, a swash plate, an adjuster, a piston and an actuator. The swash plate is a plate partly connected to the rotary shaft. The adjuster clips the peripheral rim of the swash plate. The piston has a piston connecting rod moving reciprocally and linearly to provide a driving power. The piston connecting rod is connected to the adjuster. The motion of the piston drives the adjuster, to move linearly. As a result, the swash plate is driven to rotate the rotary shaft. The actuator can change the clipping position of the adjuster on the swash plate, thereby results in different perimeter tracks of the motion of the connecting rod on the swash plate. Different height variations are generated to alter the piston stroke.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
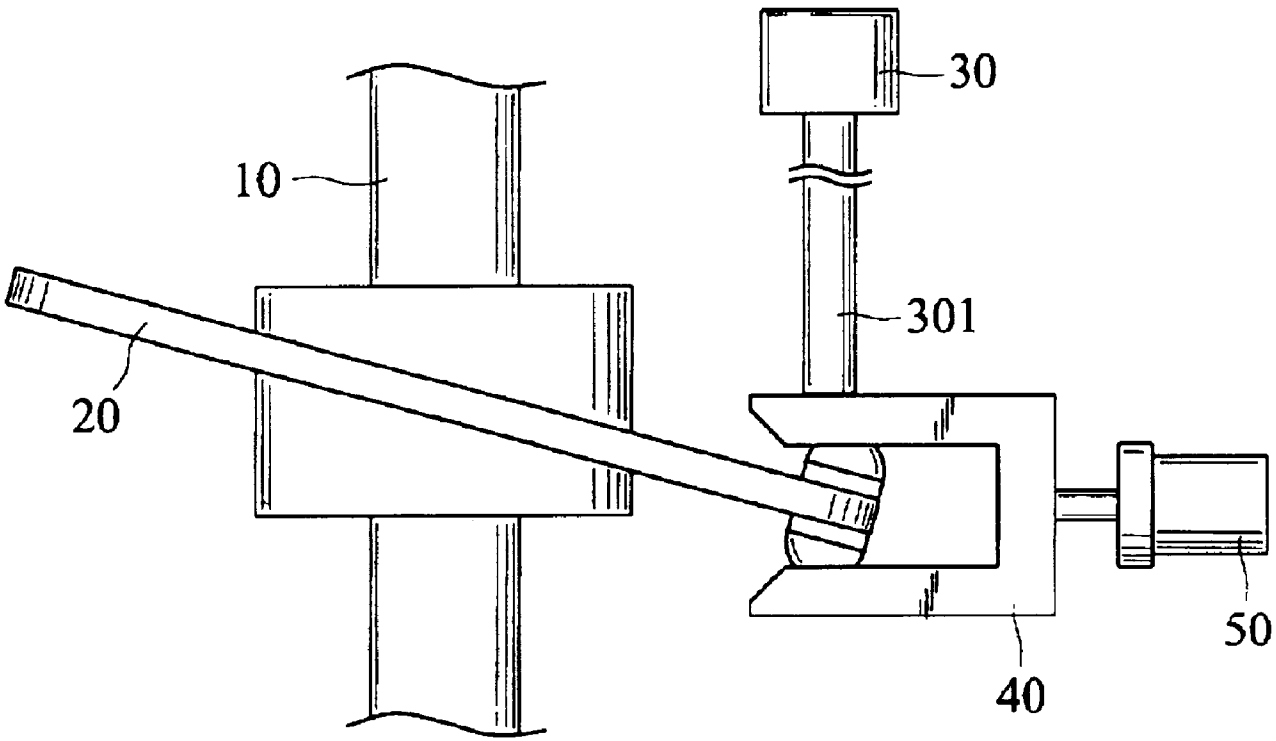
FIG. 1 is a schematic side view of the stirling engine of the variable stroke of the invention.

Referring to FIG. 1, the stirling engine of variable stroke of the invention has a rotary shaft 10, a swash plate 20, an adjuster 40, a piston 30 and an actuator 50. The swash plate 20 is a plate partly connected to the rotary shaft 10. The adjuster 40 clips the peripheral rim of the swash plate 20. The piston 30 has a piston connecting rod 301 moving reciprocally and linearly to provide a driving power. The piston connecting rod 301 is connected to the adjuster 40. The motion of the piston 30 drives the adjuster 40 moving linearly. As a result, the swash plate 20 is driven to rotate the rotary shaft 10.

Figure 4:
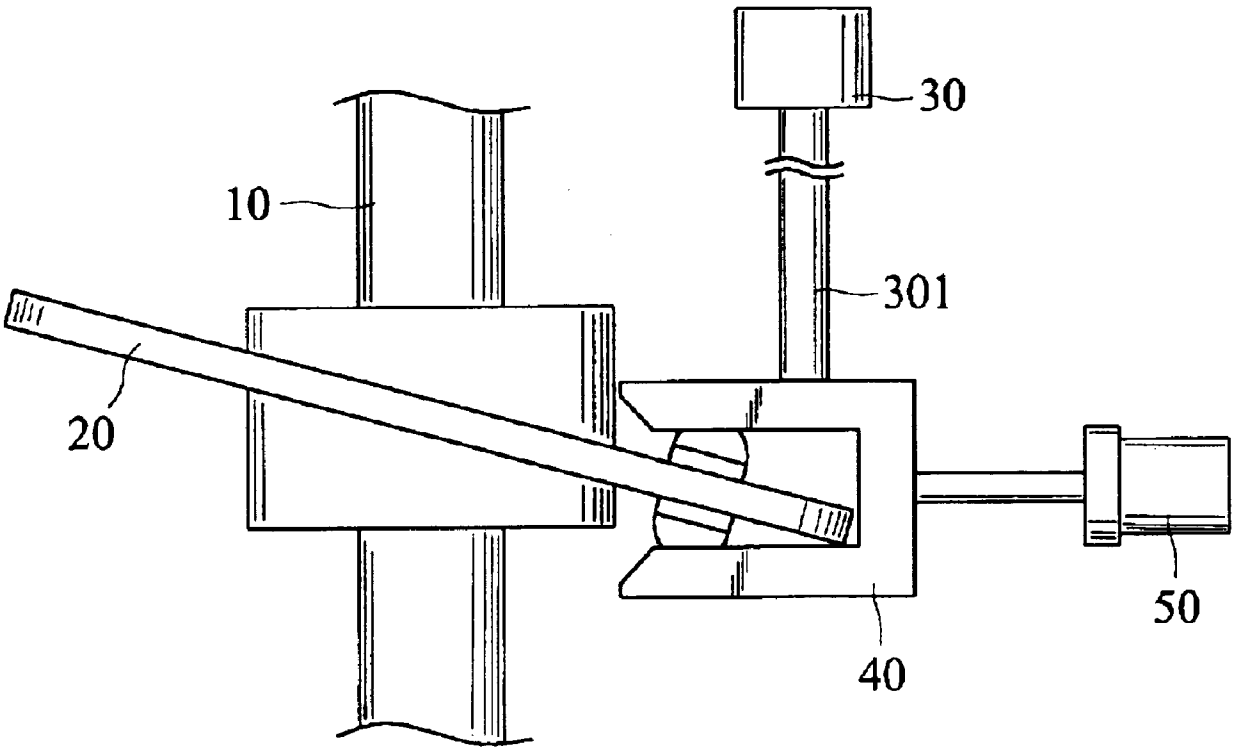
FIG. 4 is a schematic side view of the stirling engine of the variable stroke of the invention after the stroke has been adjusted.

The center normal line of the swash plate 20 forms an angle with the longitudinal axis of the rotary shaft 10. When the piston connecting rod 301 of the piston 30 moves reciprocally and linearly, as the piston connecting rod 301 is in contact with the adjuster 40, and the adjuster 40 is formed substantially in U-shape, the movement of the piston connecting rod 301 also drives the adjuster 40 moving reciprocally. Thus the swash plate 20 is forced to rotate and consequently drives the rotary shaft 10 to rotate to output power. The actuator 50 drives the adjuster 40 inwards to clip the swash plate as shown in FIG. 4. The actuator 50 may be made in a desired form as long as it can drive the adjuster 40.

Figure 2A:
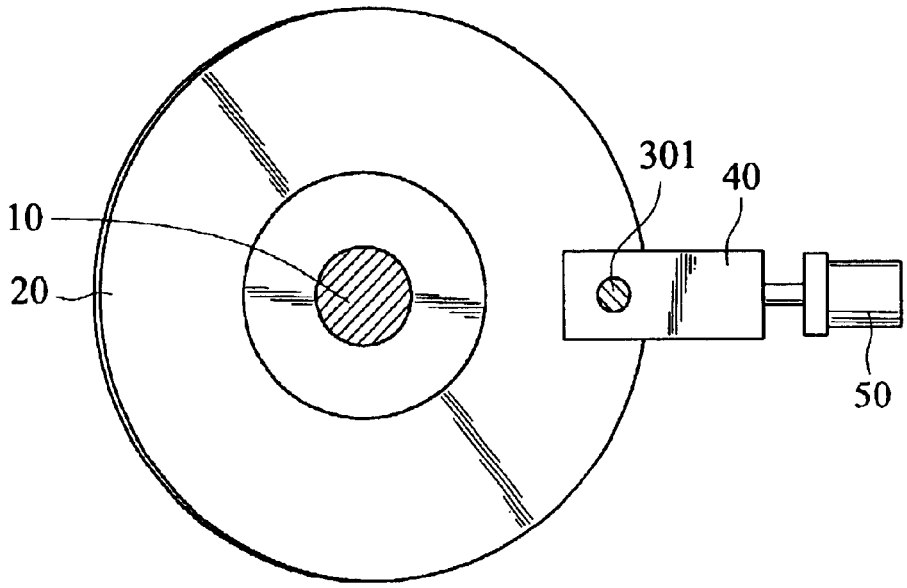
FIG. 2A is a schematic top view of the stirling engine of the variable stroke of the invention before the stroke is adjusted.
Figure 2B:
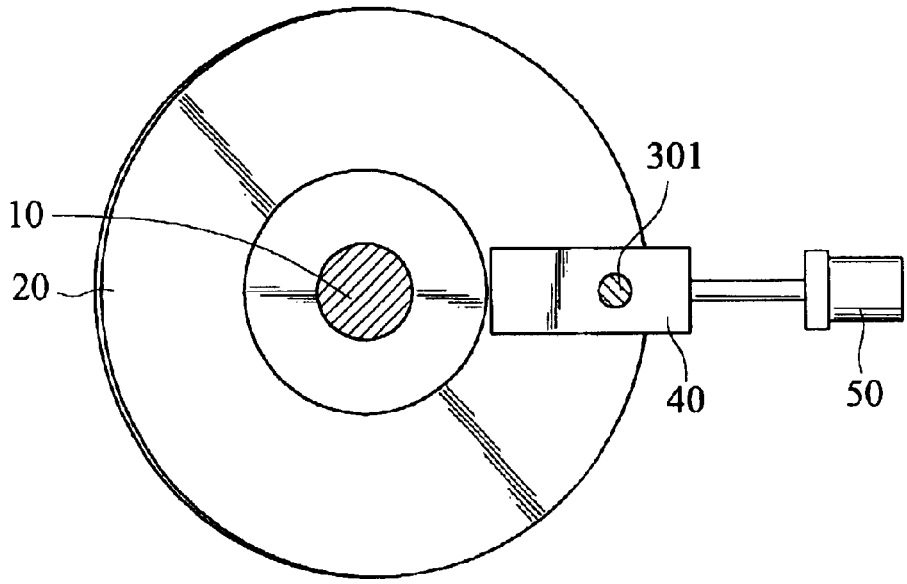
FIG. 2B is a schematic top view of the stirling engine of the variable stroke of the invention after the stroke has been adjusted.
Figure 3B:
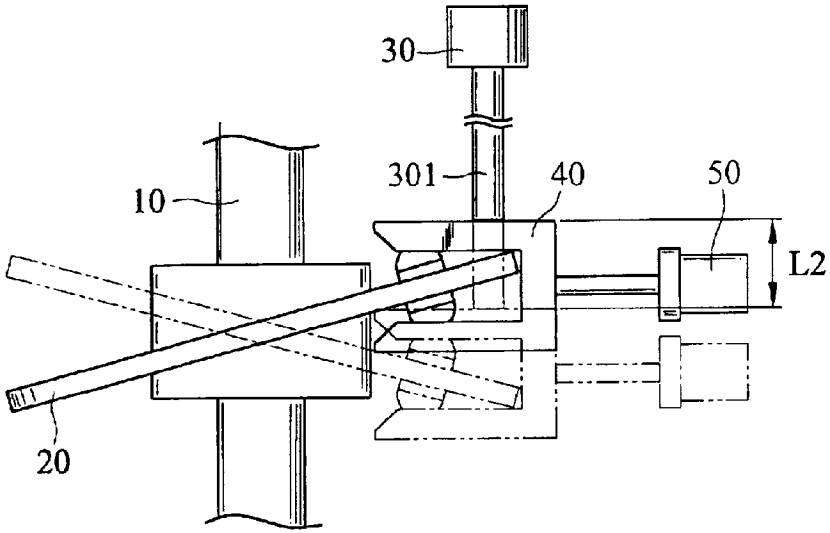
FIGS. 3A and 3B are comparing schematic views of the stirling engine of the variable stroke of the invention before and after the stroke has been adjusted.
Figure 3A:
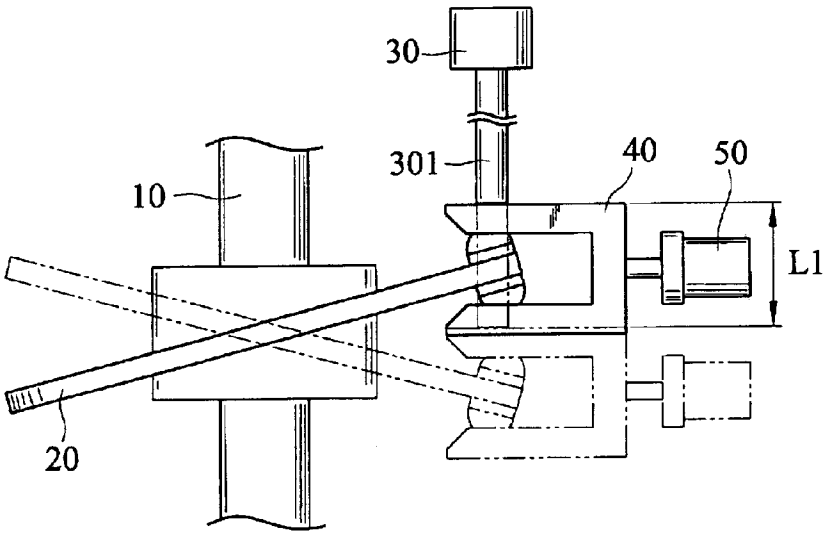

Refer to FIGS. 2A and 2B for the principle of the invention. The position of the piston connecting rod 301 and the swash plate 20 does not change. However, when the adjuster 40 is moved inwards, the movable distance of the piston connecting rod 301 is restricted. As shown in FIGS. 3A and 3B, the stroke L1 before the adjustment is greater than the stroke L2 after the adjustment, thus the torque is changed and output power may be controlled as desired. Variation of the stroke is made as follow:

$$L=r\sin(a)$$

where L is the stroke, r is the distance between the contact point of the piston connecting rod 301 and both the swash plate 20 and the center of the circle, a is the angle of the swash plate 20.

To achieve double acting of the stirling engine, a plurality of pistons 30, adjusters 40 and actuators 50 may be provided for the upper and lower sides of the swash plate 20.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments not departing from the spirit and scope of the invention.

What is claimed is:

1. A stirling engine with variable stroke, comprising:

a rotary shaft;

a swash plate being a plate coupled on the rotary shaft in a biased manner;

an adjuster clipping the peripheral rim of the swash plate;

a piston having a piston connecting rod moving reciprocally and linearly to provide a driving power, the piston connecting rod being in contact with the adjuster such that motion of the piston drives the adjuster moving linearly and consequently driving the swash plate to rotate the rotary shaft; and an actuator connecting to the adjuster for changing clipping position of the adjuster on the swash plate to alter the stroke of the piston.

2. The stirling engine with variable stroke of claim 1, wherein the swash plate has a center normal line forming an angle with the longitudinal axis of the rotary shaft.

3. The stirling engine with variable stroke of claim 2, wherein the stroke of the piston is altered by changing the angle and the moving distance of the adjuster.

4. The stirling engine with variable stroke of claim 1, wherein the adjuster is formed in a U-shaped structure for clipping the peripheral rim of the swash plate.

5. The stirling engine with variable stroke of claim 1 further having a plurality of pistons.

6. The stirling engine with variable stroke of claim 5, wherein the pistons are clipped on the swash plate by means of a plurality of controllers.

7. The stirling engine with variable stroke of claim 6, wherein the controllers are connected to a plurality of actuators.

8. The stirling engine with variable stroke of claim 1, wherein the adjuster moves perpendicular to the rotary shaft.

* * * * *